US012781480B2

(12) United States Patent
Ye et al.

(10) Patent No.: US 12,781,480 B2
(45) Date of Patent: Nov. 3, 2026

(54) FAUCET

(71) Applicant: Xiamen Lota International Co., Ltd., Xiamen (CN)

(72) Inventors: Liming Ye, Xiamen (CN); Shuanglin Bai, Xiamen (CN); Chuanbao Zhu, Xiamen (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 139 days.

(21) Appl. No.: 18/932,698

(22) Filed: Oct. 31, 2024

(65) Prior Publication Data

US 2025/0327281 A1 Oct. 23, 2025

(30) Foreign Application Priority Data

Apr. 22, 2024 (CN) ..... 202410486793.6

(51) Int. Cl.
*E03C 1/04* (2006.01)

(52) U.S. Cl.
CPC ..... *E03C 1/0401* (2013.01)

(58) Field of Classification Search
CPC ..... E03C 1/0401; E03C 1/02; E03C 1/021; E03C 1/025; E03C 1/0402; E03C 2001/0416
See application file for complete search history.

(56) References Cited

U.S. PATENT DOCUMENTS 5,381,830 A * 1/1995 Niemann ..... E03C 1/0401 285/280
7,698,755 B2 * 4/2010 McNerney ..... E03C 1/0401 4/695
8,407,828 B2 * 4/2013 Vogel ..... E03C 1/23 4/678

FOREIGN PATENT DOCUMENTS

CN 103243782 A * 8/2013 ..... E03C 1/0402

* cited by examiner

*Primary Examiner* — Paul R Durand
*Assistant Examiner* — Noah Jacob Arif
(74) *Attorney, Agent, or Firm* — COOPER LEGAL GROUP LLC

(57) ABSTRACT

A faucet includes a water outlet member, a countertop installation assembly, and two valve assemblies. The countertop installation assembly includes a mounting seat, a locking assembly, and a mounting panel. The mounting seat and the two valve assemblies are fixedly disposed on the mounting panel, and the mounting panel is configured to be placed on an upper side of a countertop. The mounting seat is operatively connected to the locking assembly to enable at least part of the locking assembly to abut a lower side of the countertop to enable the mounting panel to be fixedly connected to the countertop. The water outlet member is detachably mounted on the mounting seat, and the two valve assemblies are in fluid communication with the water outlet member.

17 Claims, 7 Drawing Sheets

FAUCET

RELATED APPLICATIONS

This application claims priority to Chinese patent application number 202410486793.6, filed on Apr. 22, 2024. Chinese patent application number 202410486793.6 is incorporated herein by reference.

FIELD OF THE DISCLOSURE

The present disclosure relates to sanitary products, and in particular to a faucet.

BACKGROUND OF THE DISCLOSURE

In existing technologies, double-handle basin faucets are typically installed and secured using an under-counter nut structure. The double-handle basin faucets usually comprise a spout and two valve assemblies. A lower end of each of the spout and the two valve assemblies comprises a threaded pipe, and the threaded pipes pass through mounting holes on a countertop. The threaded pipes extend through the installation holes and are fastened underneath the countertop by screwing nuts onto the threaded pipes. The nuts are tightened until the nuts press an underside of the countertop, securing the three components in place. Afterward, the water connections are made. However, this installation method requires separately securing three nuts, and all work must be performed under the countertop, making the process tedious and complicated.

There is existing technology for faucet installation that comprises a mounting base, a screw rod, a nut, a lifting seat that moves up and down when the screw rod is rotated to drive the nut, and two lever arms. The mounting base has a mounting hole, and the screw rod is placed on a side of the mounting hole. The two lever arms are pivotally connected to the lifting seat. This method allows for faucet installation from above the countertop, simplifying assembly and eliminating the need to rely on the structure of the faucet, making it compatible with various faucet designs. Additionally, only a single screw rod is used, minimizing the space occupied by the installation hole and allowing the faucet hoses to pass through smoothly. However, the two valve assemblies on two sides of the spout still require under-counter nuts for installation, preventing a complete one-step installation process.

BRIEF SUMMARY OF THE DISCLOSURE

The objective of the present disclosure is to overcome the deficiencies present in the existing technologies by providing a faucet that allows two valve assemblies and a water outlet member to be installed onto a countertop from above.

In order to solve the above technical problems, the present disclosure provides a faucet comprising a water outlet member, a countertop installation assembly, and two valve assemblies. The countertop installation assembly comprises a mounting seat, a locking assembly, and a mounting panel, and the mounting seat and the two valve assemblies are fixedly disposed on the mounting panel. The mounting panel is configured to be placed on an upper side of a countertop, and at least part of the locking assembly is disposed below a lower side of the mounting seat. The mounting seat is located above an upper side of the mounting panel, and the at least part of the locking assembly is located below a lower side of the mounting panel. The mounting seat is operatively connected to the locking assembly to enable the at least part of the locking assembly to abut a lower side of the countertop to enable the mounting panel to be fixedly connected to the countertop. The water outlet member is detachably mounted on the mounting seat, and the two valve assemblies are in fluid communication with the water outlet member.

In a preferred embodiment, the mounting seat comprises a buckle member, and a lower end of the water outlet member is configured to be sleeved on the mounting seat. The lower end of the water outlet member comprises a locking hole, and the buckle member is operatively locked to the locking hole.

In a preferred embodiment, the water outlet member comprises an operating button, and the operating button is configured to be pressed inward radially by an external force. The operating button is configured to push the buckle member to move radially to be separated from the locking hole.

The buckle member is configured to be elastically deformed to rotate around a lower end of the buckle member, and the buckle member comprises a buckling protrusion. An outer side of an upper end of the buckle member comprises a matching notch, and the operating button is configured to be elastically deformed to rotate around an upper end of the operating button. A lower end of the operating button is configured to be correspondingly matched with the matching notch, and when the operating button is pressed inward radially by the external force to rotate radially inward, the lower end of the operating button pushes the upper end of the buckle member inward to enable the buckling protrusion to be separated from the locking hole.

In a preferred embodiment, the lower end of the water outlet member comprises an operating through hole, and the operating button passes through the operating through hole.

In a preferred embodiment, the mounting seat comprises a base body and a connecting sleeve, and the base body is fixedly connected to the mounting panel. The connecting sleeve is sleeved outside the base body, and the water outlet member is detachably connected to the connecting sleeve.

In a preferred embodiment, the base body comprises a middle through hole, and a water outlet pipe passes through the middle through hole.

In a preferred embodiment, the locking assembly comprises a threaded column, a movable member, and an abutment member. The threaded column is operatively rotatably disposed on the mounting seat, and the movable member is threaded onto the threaded column. When the threaded column is rotated, the movable member is configured to move up and down along the threaded column to be configured to abut the lower side of the countertop.

The locking assembly comprises a plug and two guiding pins. The plug is located below the mounting seat, and the two guiding pins are connected to the plug and the mounting seat.

The abutment member comprises two rotating rods. The two rotating rods are rotatably connected to two sides of the movable member, and rotation centers of the two rotating rods are offset from middle positions of the two rotating rods.

In a preferred embodiment, each of the two valve assemblies comprises a valve body and a handle assembly. The valve body is fixedly connected to the mounting panel, and the handle assembly is connected to the valve body.

In a preferred embodiment, the mounting panel comprises two mounting through grooves spaced apart from each other, and a sidewall of each of the two mounting through grooves comprises a plurality of grooves spaced apart from each other. An outer wall of the valve body comprises a plurality of strip-shaped protrusions spaced apart from each other, and the valve body is disposed in a corresponding one of the two mounting through grooves. The plurality of strip-shaped protrusions are matched with the plurality of grooves.

In a preferred embodiment, each of two sides of the mounting panel comprises a plurality of side grooves in communication with the two mounting through grooves. Tops of the plurality of side grooves are closed, and two sides of the valve body comprise a plurality of mounting lugs. The valve body is installed from below the mounting panel, and the plurality of mounting lugs are disposed in the plurality of side grooves. The plurality of mounting lugs are fastened to the plurality of side grooves with screws.

In a preferred embodiment, a lower end of the valve body is connected to a water inlet pipe and a valve outlet pipe, and the water inlet pipe is configured to be in communication with hot water or cold water. The valve outlet pipes of the valve bodies are connected to a water outlet pipe of the water outlet member through a three-way connector.

In a preferred embodiment, the faucet comprises a decorative panel, and the decorative panel covers on an upper side of the mounting panel.

Compared with the existing techniques, the technical solution has the following advantages.

The countertop installation assembly further comprises a mounting seat and a locking assembly. At least part of the locking assembly is disposed below a lower side of the mounting seat. The mounting seat is located above the upper side of the mounting panel, and the at least part of the locking assembly is located below a lower side of the mounting panel. The mounting seat is operatively connected to the locking assembly to enable the at least part of the locking assembly to abut a lower side of the countertop to enable the mounting panel to be fixedly connected to the countertop. The water outlet member is detachably mounted on the mounting seat, and the two valve assemblies are in fluid communication with the water outlet member.

During installation, the two valve assemblies are fixedly connected to the mounting panel. The countertop installation assembly is fixedly connected to the mounting panel. The two valve assemblies, the countertop installation assembly, and the mounting panel form an integrated structure when installed on the countertop. It is only necessary to correspondingly insert lower ends of the two valve assemblies and the at least part of the locking assembly of the countertop installation assembly into three mounting holes on the countertop, so that the mounting panel is placed on the upper side of the countertop. Then, by controlling the locking assembly, the at least part of the locking assembly abuts the lower side of the countertop, securing the mounting panel to the countertop. Finally, the water outlet member is connected to the mounting seat, and the two valve assemblies are in fluid communication with the water outlet member, completing the installation of the double-handle faucet. The entire installation process is completed on the countertop, making it convenient and efficient.

DETAILED DESCRIPTION OF THE EMBODIMENTS

The present disclosure will be further described below in conjunction with the accompanying drawings and embodiments.

Figure 1:
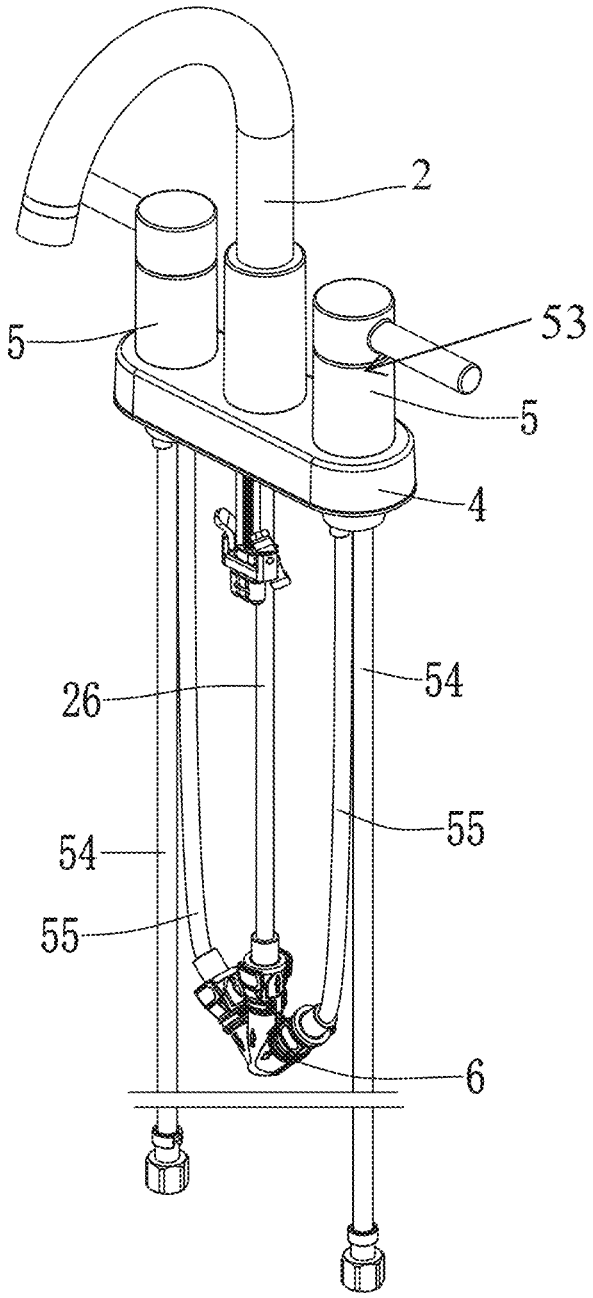
FIG. 1 is a perspective view of a faucet in a preferred embodiment of the present disclosure.
Figure 2:
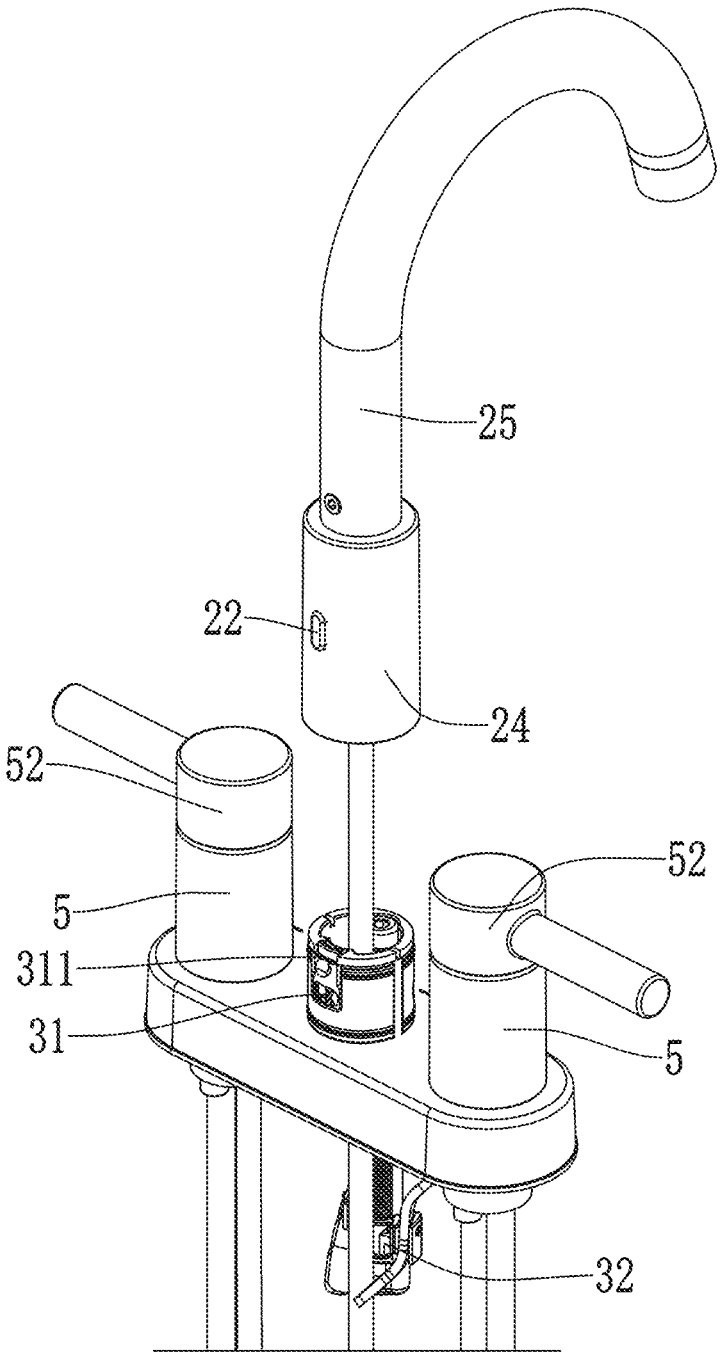
FIG. 2 is an exploded view of the faucet in the preferred embodiment of the present disclosure, when a water outlet member is separated from a mounting seat.
Figure 3:
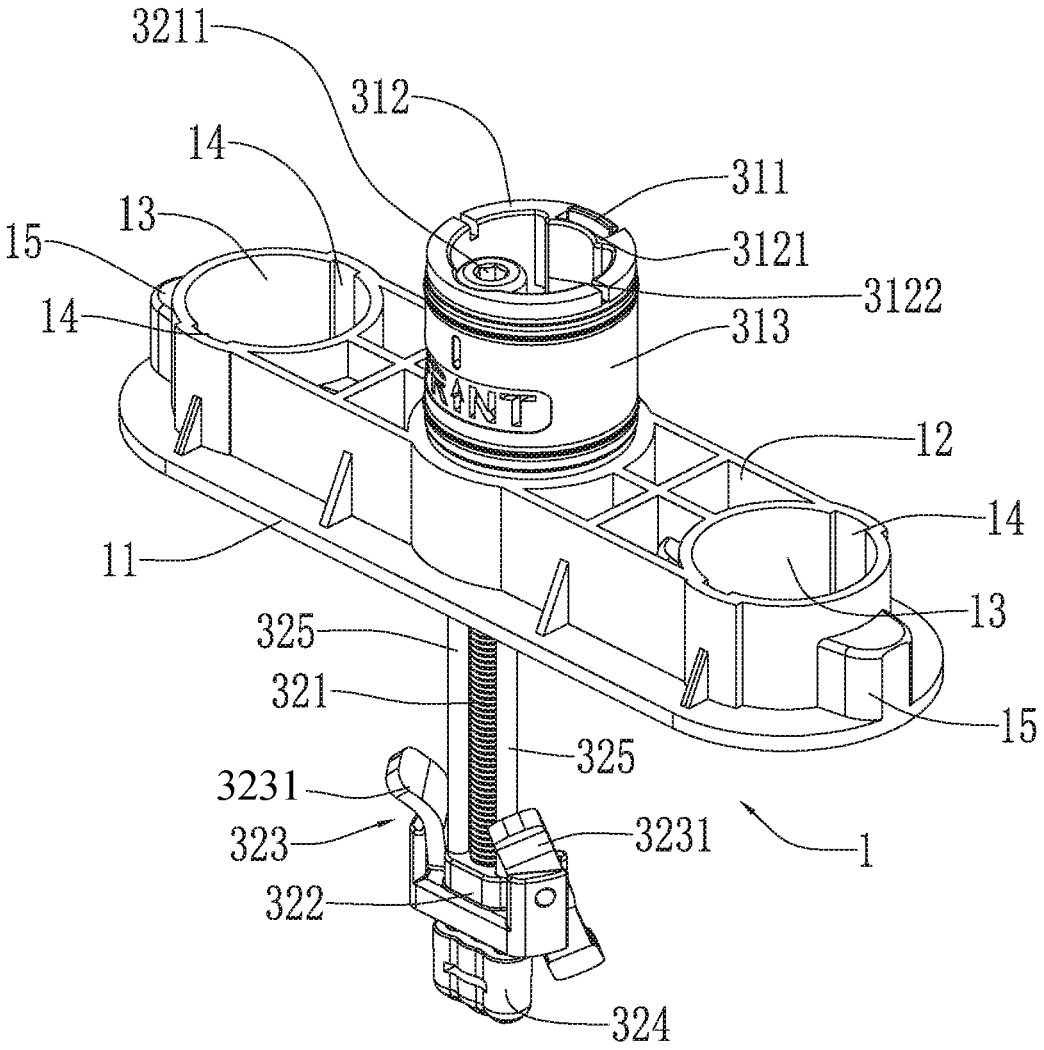
FIG. 3 is a perspective view of a countertop installation assembly in the preferred embodiment of the present disclosure.
Figure 4:
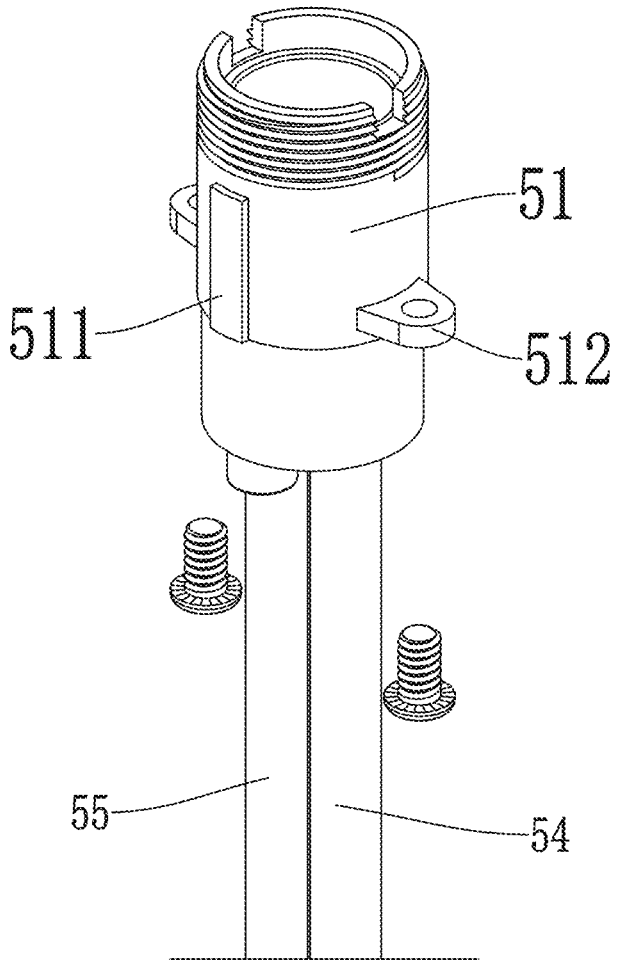
FIG. 4 is a perspective view of a valve body in the preferred embodiment of the present disclosure.
Figure 5:
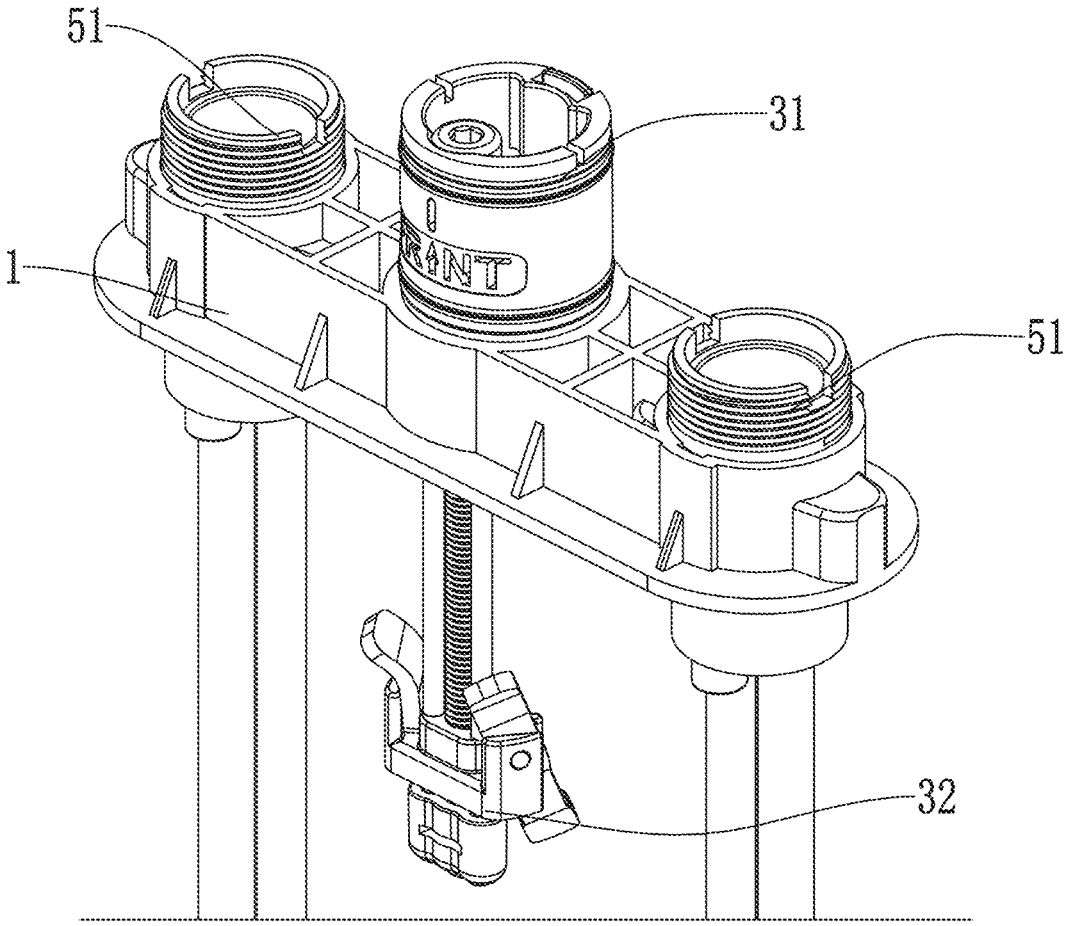
FIG. 5 is a perspective view of the valve bodies and the countertop installation assembly being fixedly disposed on a mounting panel in the preferred embodiment of the present disclosure.
Figure 6:
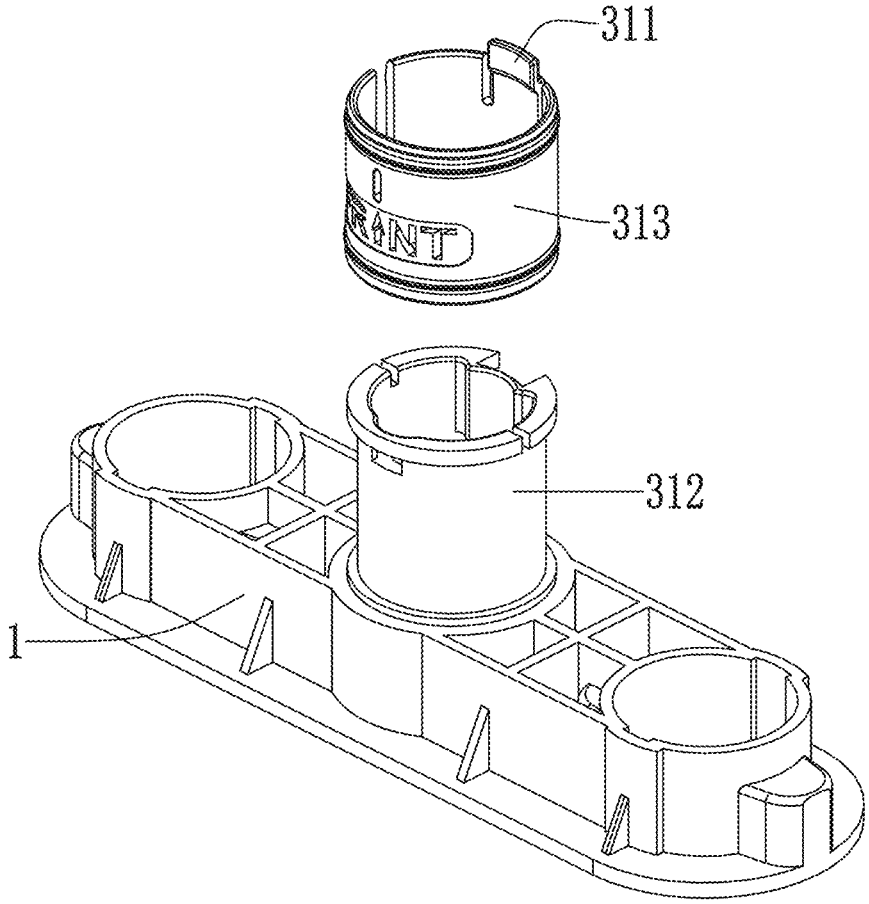
FIG. 6 is a perspective view of a connecting sleeve being detached from a base body in the preferred embodiment of the present disclosure.
Figure 7:
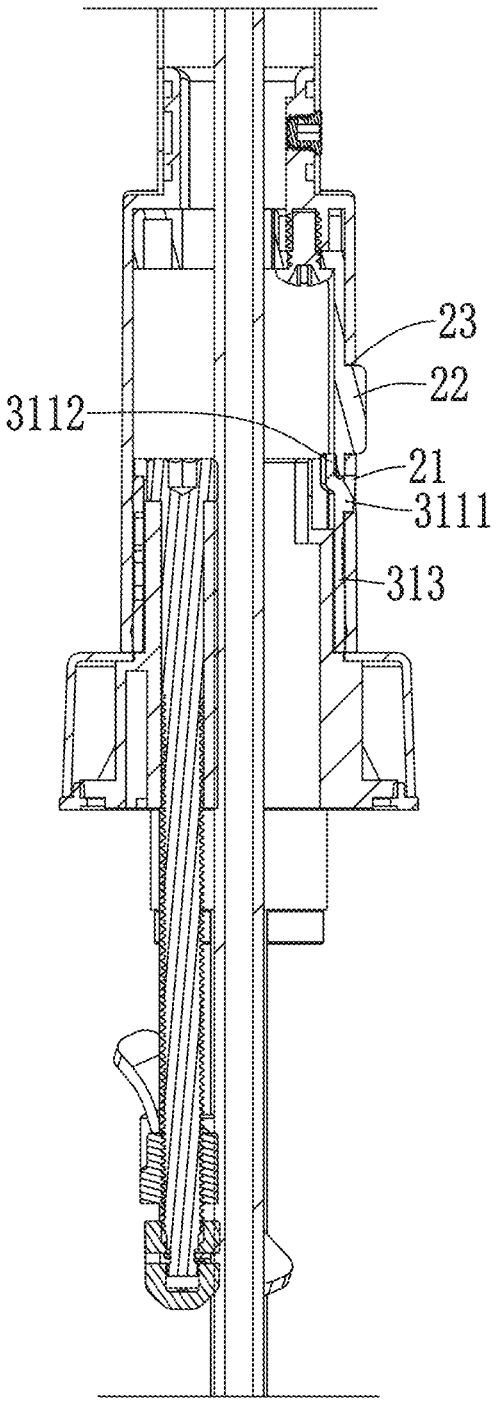
FIG. 7 is a cross-sectional view of the faucet in the preferred embodiment of the present disclosure.

Referring to FIGS. 1 to 7, a faucet is disclosed. The faucet comprises a water outlet member 2, a countertop installation assembly, a decorative panel 4, and two valve assemblies 5. The faucet is configured for installation on countertops, such as kitchen sinks or washbasins. The types of the countertops are not limited to those and can be understood as a supporting panel for placing the faucet.

The countertop installation assembly comprises a mounting panel 1. The mounting panel 1 comprises a base plate 11 and a mounting body 12 disposed on the base plate 11. A lower side of the base plate 11 is correspondingly disposed on an upper side of a countertop. The countertop installation assembly and the two valve assemblies 5 are fixedly disposed on the mounting body 12. In this embodiment, the mounting panel 1 is capsule-shaped (i.e., a shape formed by two semicircles connected by parallel lines). The decorative panel 4 covers an upper side of the mounting panel 1, and the decorative panel 4 can be made of metal for aesthetic purposes.

The countertop installation assembly further comprises a mounting seat 31 and a locking assembly 32. At least part of the locking assembly 32 is disposed below a lower side of the mounting seat 31. The mounting seat 31 is located above the upper side of the mounting panel 1, and the at least part of the locking assembly 32 is located below a lower side of the mounting panel 1. The mounting seat 31 is operatively connected to the locking assembly 32 to enable the at least part of the locking assembly 32 to abut a lower side of the countertop to enable the mounting panel 1 to be fixedly connected to the countertop. The water outlet member 2 is detachably mounted on the mounting seat 31, and the two valve assemblies 5 are in fluid communication with the water outlet member 2.

Therefore, during installation, the two valve assemblies 5 are fixedly connected to the mounting panel 1. The countertop installation assembly is fixedly connected to the mounting panel 1. The two valve assemblies 5, the countertop installation assembly, and the mounting panel 1 form an integrated structure when installed on the countertop. It is only necessary to correspondingly insert lower ends of the two valve assemblies 5 and the at least part of the locking assembly 32 of the countertop installation assembly into three mounting holes on the countertop, so that the mounting panel 1 is placed on the upper side of the countertop. Then, by controlling the locking assembly 32, the at least part of the locking assembly 32 abuts the lower side of the countertop, securing the mounting panel 1 to the countertop. Finally, the water outlet member 2 is connected to the mounting seat 31, and the two valve assemblies 5 are in fluid communication with the water outlet member 2, completing the installation of the double-handle faucet.

In a preferred embodiment, the mounting seat 31 comprises a buckle member 311, and a lower end of the water outlet member 2 is configured to be sleeved on the mounting seat 31. The lower end of the water outlet member 2 comprises a locking hole 21, and the buckle member 311 is operatively locked to the locking hole 21. The water outlet member 3 further comprises an operating button 22. The operating button 22 can be pressed inward radially by an external force, and the operating button 22 is configured to push the buckle member 311 to move radially to be separated from the locking hole 21. The buckle member 311 can be elastically deformed to rotate around a lower end of the buckle member 311. The buckle member 311 comprises a buckling protrusion 3111. An outer side of an upper end of the buckle member 311 comprises a matching notch 3112. The operating button 22 can be elastically deformed to rotate around an upper end of the operating button 22, and a lower end of the operating button 22 can be correspondingly matched with the matching notch 3112. When the operating button 22 is pressed inward radially by the external force to rotate radially inward, the lower end of the operating button 22 pushes the upper end of the buckle member 311 inward to enable the buckling protrusion 3111 to be separated from the locking hole 21. The lower end of the water outlet member 2 further comprises an operating through hole 23, and the operating button 22 passes through the operating through hole 23. In this embodiment, the locking hole 21 and the operating through hole 23 are arranged side by side in an up-and-down direction.

In this embodiment, the mounting seat 31 comprises a base body 312 and a connecting sleeve 313. The base body 312 is fixedly connected to the mounting panel 1. In this embodiment, the base body 312 is integrally formed with the mounting panel 1, and the connecting sleeve 313 is sleeved outside the base body 312. The water outlet member 2 is detachably connected to the connecting sleeve 313.

The connecting sleeve 313 is sleeved on the base body 312. An outer sidewall of the base body 312 comprises a notch groove 3121, and the connecting sleeve 313 comprises the buckle member 311. The buckle member 311 can be elastically deformed radially to be correspondingly moved into or out of the notch groove 3121.

The base body 312 comprises a middle through hole 3122, and a water outlet pipe 26 passes through the middle through hole 3122. The locking assembly 32 comprises a threaded column 321, a movable member 322, and an abutment member 323. The threaded column 321 is operatively rotatably disposed on the mounting seat 31, and the movable member 322 is threaded onto the threaded column 321. When the threaded column 321 is rotated, the movable member 322 can move up and down along the threaded column 321 to abut the lower side of the countertop. The locking assembly 32 further comprises a plug 324 and two guiding pins 325. The plug 324 is located below the mounting seat 31, and the two guiding pins 325 are connected to the plug 324 and the mounting seat 31. The movable member 322 is slidably disposed on the two guiding pins 325. The abutment member 323 comprises two rotating rods 3231, and the two rotating rods 3231 are rotatably connected to two sides of the movable member 322. Rotation centers of the two rotating rods 3231 are offset from middle positions of the two rotating rods 3231. As a result, the two rotating rods 3231 will droop due to gravity. When upper ends of the two rotating rods 3231 abut the lower side of the countertop, the two rotating rods 3231 will rotate accordingly until entire rod bodies of the two rotating rods 3231 abut the lower side of the countertop, which is a conventional structure that will not be further elaborated upon here. An upper end of the threaded column 321 comprises a connecting port 3211. The connecting port 3211 is a hex socket. The connecting port 3211 is located on an upper side of the mounting seat 31, so the user can directly operate the connecting port 3211 from above the countertop to enable the locking assembly 32 to be connected to the countertop. The countertop is clamped between the mounting panel 1 and the locking assembly 32.

In this embodiment, each of the two valve assemblies 5 comprises a valve body 51 and a handle assembly 52. The valve body 51 is fixedly connected to the mounting panel 1, and the handle assembly 52 is connected to the valve body 51. The mounting panel 1 comprises two mounting through grooves 13 spaced apart from each other, and a sidewall of each of the two mounting through grooves 13 comprises a plurality of grooves 14 spaced apart from each other. An outer wall of the valve body 51 comprises a plurality of strip-shaped protrusions 511 spaced apart from each other. The valve body 51 is disposed in a corresponding one of the two mounting through grooves 13, and the plurality of strip-shaped protrusions 511 are matched with the plurality of grooves 14. Each of two sides of the mounting panel 1 comprises a plurality of side grooves 15 in communication with the two mounting through grooves 13. Tops of the plurality of side grooves 15 are closed, and two sides of the valve body 51 comprise a plurality of mounting lugs 512. The valve body 51 is installed from below the mounting panel 1, and the plurality of mounting lugs 512 are inserted into the plurality of side grooves 15. The plurality of mounting lugs 512 are fastened to the plurality of side grooves 15 with screws. In this embodiment, each of the two valve assemblies 5 comprises a valve cover 53. The valve cover 53 covers an upper side of the valve body 51, and the handle assembly 52 is connected to the valve cover 53.

A lower end of the valve body 51 is connected to a water inlet pipe 54 and a valve outlet pipe 55. The water inlet pipe 54 is configured to be in communication with hot water or cold water. The valve outlet pipes 55 of the valve bodies 51 are connected to the water outlet pipe 26 of the water outlet member 2 through a three-way connector 6. The three-way connector 6 is connected to the valve outlet pipes 55 and the water outlet pipe 26, and mixed water is formed within the three-way connector 6 and then flows into the water outlet pipe 26. The water outlet member 2 comprises a spout base 24 and a spout 25 rotatably connected to the spout base 24. The spout base 24 is connected to the mounting seat 31. The water outlet pipe 26 extends through the spout base 24 and the spout 25, and the water outlet pipe 26 discharges water from a distal end of the spout 25.

The aforementioned embodiments are merely some embodiments of the present disclosure, and the scope of the disclosure is not limited thereto. Thus, it is intended that the present disclosure cover non-substantive modifications of the present disclosure provided they are made based on the concept within the technical scope disclosed in the present disclosure by any technical person skilled in the art.

What is claimed is:

1. A faucet, comprising:

a water outlet member, a countertop installation assembly, and two valve assemblies, wherein:

the countertop installation assembly comprises a mounting seat, a locking assembly, and a mounting panel, the mounting seat and the two valve assemblies are fixedly disposed on the mounting panel, the mounting panel is configured to be placed on an upper side of a countertop, at least part of the locking assembly is disposed below a lower side of the mounting seat, the mounting seat is located above an upper side of the mounting panel, the at least part of the locking assembly is located below a lower side of the mounting panel, the mounting seat is operatively connected to the locking assembly to enable the at least part of the locking assembly to abut a lower side of the countertop to enable the mounting panel to be fixedly connected to the countertop, the water outlet member is detachably mounted on the mounting seat, the two valve assemblies are in fluid communication with the water outlet member, the mounting seat comprises a buckle member, a lower end of the water outlet member is configured to be sleeved on the mounting seat, the lower end of the water outlet member comprises a locking hole, and the buckle member is operatively locked to the locking hole.

2. The faucet according to claim 1, wherein:

the water outlet member comprises an operating button, the operating button is configured to be pressed inward radially by an external force, the operating button is configured to push the buckle member to move radially to be separated from the locking hole, the buckle member is configured to be elastically deformed to rotate around a lower end of the buckle member, the buckle member comprises a buckling protrusion, an outer side of an upper end of the buckle member comprises a matching notch, the operating button is configured to be elastically deformed to rotate around an upper end of the operating button, a lower end of the operating button is configured to be correspondingly matched with the matching notch, and when the operating button is pressed inward radially by the external force to rotate radially inward, the lower end of the operating button pushes the upper end of the buckle member inward to enable the buckling protrusion to be separated from the locking hole.

3. The faucet according to claim 2, wherein:

the lower end of the water outlet member comprises an operating through hole, and the operating button passes through the operating through hole.

4. The faucet according to claim 1, wherein:

the mounting seat comprises a base body and a connecting sleeve, the base body is fixedly connected to the mounting panel, the connecting sleeve is sleeved outside the base body, and the water outlet member is detachably connected to the connecting sleeve.

5. The faucet according to claim 4, wherein:

the base body comprises a middle through hole, and a water outlet pipe passes through the middle through hole.

6. The faucet according to claim 1, wherein:

the locking assembly comprises a threaded column, a movable member, and an abutment member, the threaded column is operatively rotatably disposed on the mounting seat, the movable member is threaded onto the threaded column, when the threaded column is rotated, the movable member is configured to move up and down along the threaded column to be configured to abut the lower side of the countertop, the locking assembly comprises a plug and two guiding pins, the plug is located below the mounting seat, the two guiding pins are connected to the plug and the mounting seat, the abutment member comprises two rotating rods, the two rotating rods are rotatably connected to two sides of the movable member, and rotation centers of the two rotating rods are offset from middle positions of the two rotating rods.

7. The faucet according to claim 1, wherein:

each of the two valve assemblies comprises a valve body and a handle assembly, the valve body is fixedly connected to the mounting panel, and the handle assembly is connected to the valve body.

8. The faucet according to claim 7, wherein:

the mounting panel comprises two mounting through grooves spaced apart from each other, a sidewall of each of the two mounting through grooves comprises a plurality of grooves spaced apart from each other, an outer wall of the valve body comprises a plurality of strip-shaped protrusions spaced apart from each other, the valve body is disposed in a corresponding one of the two mounting through grooves, and the plurality of strip-shaped protrusions are matched with the plurality of grooves.

9. The faucet according to claim 8, wherein:

each of two sides of the mounting panel comprises a plurality of side grooves in communication with the two mounting through grooves, tops of the plurality of side grooves are closed, two sides of the valve body comprise a plurality of mounting lugs, the valve body is installed from below the mounting panel, the plurality of mounting lugs are disposed in the plurality of side grooves, and the plurality of mounting lugs are fastened to the plurality of side grooves with screws.

10. The faucet according to claim 7, wherein:

a lower end of the valve body is connected to a water inlet pipe and a valve outlet pipe, the water inlet pipe is configured to be in communication with hot water or cold water, and the valve outlet pipes of the valve bodies are connected to a water outlet pipe of the water outlet member through a three-way connector.

11. The faucet according to claim 1, wherein:

the faucet comprises a decorative panel, and the decorative panel covers the upper side of the mounting panel.

12. The faucet according to claim 2, wherein:
the mounting seat comprises a base body and a connecting sleeve,
the base body is fixedly connected to the mounting panel,
the connecting sleeve is sleeved outside the base body, and
the water outlet member is detachably connected to the connecting sleeve.

13. The faucet according to claim 12, wherein:
the base body comprises a middle through hole, and
a water outlet pipe passes through the middle through hole.

14. The faucet according to claim 3, wherein:
the mounting seat comprises a base body and a connecting sleeve,
the base body is fixedly connected to the mounting panel,
the connecting sleeve is sleeved outside the base body, and
the water outlet member is detachably connected to the connecting sleeve.

15. The faucet according to claim 14, wherein:
the base body comprises a middle through hole, and
a water outlet pipe passes through the middle through hole.

16. A faucet, comprising:
a water outlet member,
a countertop installation assembly, and
two valve assemblies, wherein:
the countertop installation assembly comprises a mounting seat, a locking assembly, and a mounting panel,
the mounting seat and the two valve assemblies are fixedly disposed on the mounting panel,
the mounting panel is configured to be placed on an upper side of a countertop,
at least part of the locking assembly is disposed below a lower side of the mounting seat,
the mounting seat is located above an upper side of the mounting panel,
the at least part of the locking assembly is located below a lower side of the mounting panel,
the mounting seat is operatively connected to the locking assembly to enable the at least part of the locking assembly to abut a lower side of the countertop to enable the mounting panel to be fixedly connected to the countertop,
the water outlet member is detachably mounted on the mounting seat,
the two valve assemblies are in fluid communication with the water outlet member,
each of the two valve assemblies comprises a valve body and a handle assembly,
the valve body is fixedly connected to the mounting panel,
the handle assembly is connected to the valve body,
the mounting panel comprises two mounting through grooves spaced apart from each other,
a sidewall of each of the two mounting through grooves comprises a plurality of grooves spaced apart from each other,
an outer wall of the valve body comprises a plurality of strip-shaped protrusions spaced apart from each other,
the valve body is disposed in a corresponding one of the two mounting through grooves, and
the plurality of strip-shaped protrusions are matched with the plurality of grooves.

17. A faucet, comprising:
a water outlet member,
a countertop installation assembly, and
two valve assemblies, wherein:
the countertop installation assembly comprises a mounting seat, a locking assembly, and a mounting panel,
the mounting seat and the two valve assemblies are fixedly disposed on the mounting panel,
the mounting panel is configured to be placed on an upper side of a countertop,
at least part of the locking assembly is disposed below a lower side of the mounting seat,
the mounting seat is located above an upper side of the mounting panel,
the at least part of the locking assembly is located below a lower side of the mounting panel,
the mounting seat is operatively connected to the locking assembly to enable the at least part of the locking assembly to abut a lower side of the countertop to enable the mounting panel to be fixedly connected to the countertop,
the water outlet member is detachably mounted on the mounting seat,
the two valve assemblies are in fluid communication with the water outlet member,
the mounting seat comprises a base body and a connecting sleeve,
the base body is fixedly connected to the mounting panel,
the connecting sleeve is sleeved outside the base body, and
the water outlet member is detachably connected to the connecting sleeve.

* * * * *